US005417004A

United States Patent [19]

Krantz

[11] Patent Number: 5,417,004

[45] Date of Patent: May 23, 1995

[54] BULLET STARTER FOR MUZZLE LOADING FIREARM

[76] Inventor: Joseph H. Krantz, 12482 W. Tennessee Pl., Lakewood, Colo. 80228

[21] Appl. No.: 292,486

[22] Filed: Aug. 18, 1994

[51] Int. Cl.[6] ..... F41C 9/08

[52] U.S. Cl. ..... 42/90

[58] Field of Search ..... 86/28, 29, 30, 24, 43; 42/51, 90

[56] References Cited

U.S. PATENT DOCUMENTS 4,407,086 10/1983 Hasselmann ..... 42/90
5,016,380 5/1991 Jones ..... 42/90
5,169,999 12/1992 Jenkins ..... 42/90

*Primary Examiner*—Charles T. Jordan
*Assistant Examiner*—Christopher Keith Montgomery
*Attorney, Agent, or Firm*—Thomas C. Naber

[57] ABSTRACT

A bullet starter for loading a conical hollow-point bullet into a barrel of a muzzle loading firearm. The starter comprises a handle and an impact member, with the impact member comprising an outwardly protruding starter pin in communication with the handle. The starter pin is insertable into a hollow point of a hollow-point bullet, and has a diameter less than the diameter of the hollow point and a depth greater than the depth of the hollow point. These diameter and depth characteristics assure that only the floor of the hollow point has significant impact contact from the impact member when impact is applied to force the bullet into the barrel, and that the nose of the hollow-point bullet is substantially untouched by the impact member and therefore not deformed. The starter pin can be releasably retained and therefore interchangeable with differently-sized pins. The handle also can have extending therefrom a driver rod having a driver pin disposed at the end thereof and sized the same as the starter pin for insertion into the hollow point of a hollow-point bullet for moving the bullet deeper into the barrel.

14 Claims, 1 Drawing Sheet

BULLET STARTER FOR MUZZLE LOADING FIREARM

BACKGROUND OF THE INVENTION

The present invention relates in general to a bullet starter for loading bullets into a barrel of a muzzle loading firearm, and in particular to a bullet starter that can be employed to load conical hollow-point bullets without distorting the points of the bullets as they are forced with impact into the distal end of the barrel.

The sport of hunting using muzzle loading firearms is a very popular activity among many people. In addition to the actual task of hunting various animals, the muzzle-loader hunter has the added challenges of using a muzzle loading firearm in order to finally achieve the goal of his hunt. A primary challenge in using this type of gun is the necessity of loading gun powder and an individual conical bullet into the distal end of the barrel for each discharge. Because a typical barrel is constructed with significant rifling grooves along its inner wall and also is consistent in diameter with the caliber of a bullet to be loaded, loading a bullet must be accomplished with a considerable impact-force in order to achieve a successful entry of the bullet into the barrel. Such loading is accomplished using a bullet starter that has an impact member which is placed against the distal tip of the bullet and is then struck to force the bullet into the barrel. Once a successful entry is accomplished, the lateral surface of the bullet will have the rifling grooves cut therein, thereby allowing the bullet to be slid deeper into the barrel with minimal external pressure until placement is such that a triggered discharge can be entertained.

Two types of conical bullets are generally available for use in muzzle loading firearms. These two types are defined by the configurations of their respective distal ends which are either solid point or hollow point in design. While both solid-point and hollow-point bullets are available, the only bullet starter available, however, is one having an impact member that is concave in shape. This concave shape works well when impacting a solid-point bullet during its loading into the barrel. However, when this concave shape is employed for loading a hollow-point bullet, which has only a small amount of lead at its nose, the point of the bullet becomes distorted and deformed when impacted since the concave configuration is not complimentary to the hollow point design. When this occurs, projectile irregularities and inconsistencies result. Conversely, as is well-recognized, consistency and accuracy in shooting a firearm is of utmost importance, both for safety considerations and for target contact. One factor contributing to such optimum discharge performance is a bullet having little or no deformation on its surface.

Therefore, it is apparent that a need is present for a bullet starter that can be employed to properly and effectively load hollow-point bullets into the barrel of a muzzle loading firearm. Accordingly, a primary object of the present invention is to provide a bullet starter having an impact member compatible in configuration with the nose of a hollow-point bullet.

Another object of the present invention is to provide a bullet starter having a pin that fits inside the hollow point of the bullet without contacting the outside of the nose of the bullet.

Yet another object of the present invention is to provide a bullet starter having interchangeable pins to thereby be useful in loading bullets having hollow points of different calibers.

These and other objects of the present invention will become apparent in the description of the invention which now follows.

SUMMARY OF THE INVENTION

The present invention is a bullet starter for loading a conical hollow-point bullet into a barrel of a muzzle loading firearm. The starter comprises a handle and an impact member, with the impact member comprising an outwardly protruding starter pin in communication with the handle. The starter pin is insertable into a hollow point of a hollow-point bullet, and has a diameter less than the diameter of the hollow point and a depth greater than the depth of the hollow point. Such diameter and depth characteristics of the pin thereby assure that only the floor of the hollow point has significant impact contact from the impact member. In this manner the nose of the hollow-point bullet is substantially untouched by the impact member and therefore is not subjected to a deformation force when the bullet is loaded into the barrel of the gun. The starter pin can be disposed distally from the handle, such as at the end of a starter rod which is attached to the handle.

In a preferred embodiment the handle has additionally protruding therefrom a driver rod, considerably longer than the starter rod, for forcing the hollow-point bullet to a deeper site within a barrel after the bullet is lodged in the barrel. In a manner similar to the construction of the starter rod, the driver rod has a pin, here referred to as a driver pin, disposed at the end thereof for insertion into the hollow point of a hollow-point bullet. In like manner as with the starter pin, the driver pin has a diameter less than the diameter of the hollow point and has a depth greater than the depth of the hollow point to thereby prevent deformation to the nose of the bullet as earlier described.

In any embodiment, either or both of a starter pin and/or a driver pin can be releasably retained and replaceable with another releasably retained respective pin having a different diameter and/or depth, thereby providing one tool with the versatility necessary to have utility with different hollow point dimensions. As is apparent, use of a bullet starter here described and claimed accomplishes efficient loading of a hollow-point bullet into the barrel of a muzzle loading firearm without distorting the nose of the bullet. This non-distortion contributes to consistency and accuracy in providing optimum firearm discharge characteristics for sporting endeavors involving muzzle loading firearms.

BRIEF DESCRIPTION OF THE DRAWINGS

Illustrative and presently preferred embodiments of the invention are shown in the accompanying drawings in which.

DETAILED DESCRIPTION OF THE PREFERRED EMBODIMENT

Figure 1:
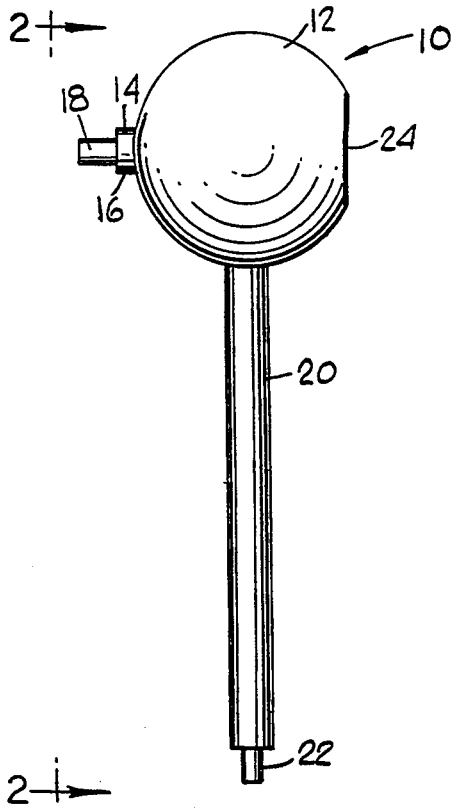
FIG. 1 is an elevation view of a bullet starter.
Figure 2:
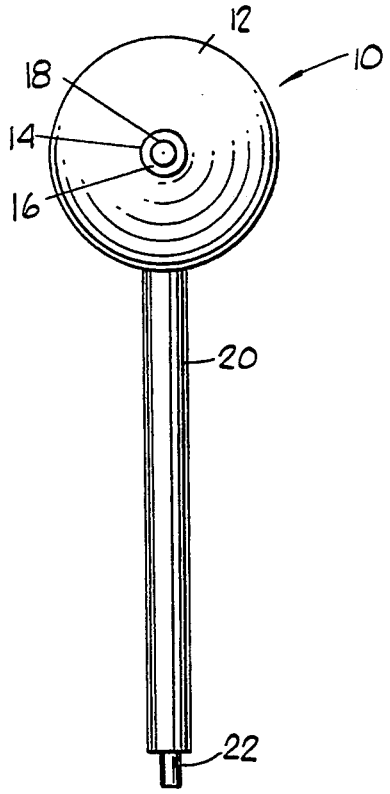
FIG. 2 is a second elevation view of the bullet starter of FIG. 1, along line 2—2 thereof.

Referring to FIGS. 1 and 2, a bullet starter 10 for loading a conical hollow-point bullet into a barrel of a muzzle loading firearm is shown. The starter 10 has a substantially spherical wooden handle 12 and an impact member 14. The impact member 14 comprises a relatively short starter rod 16 extending from the handle 12 and having disposed at its distal end a starter pin 18. At substantially 90° from the starter rod 16 a relatively long driver rod 20 extends from the handle 12. At the distal end of the driver rod 20 is disposed a driver pin 22. Both the starter pin 18 and the driver pin 22 are of a diameter smaller than the diameter of the hollow point, as described below. The spherical handle 12 has a flattened area 24 opposite the site of the starter rod 16. In the preferred embodiment the starter rod 16 and starter pin 18 are constructed from a single piece of brass or similarly soft metal or metal alloy. Likewise, the driver rod 20 and driver pin 22 are constructed from a single piece of brass or similarly soft metal or metal alloy. In the embodiment here shown, the starter rod 16 is about ¼ inch long and has a diameter of about 5/16 inch, while the starter pin 18 is about ¼ inch long and has a diameter of about ⅛ inch. The driver rod 20 is about 4 inches long and has a diameter of about 5/16 inch, while the driver pin 22 is about ¼ inch long and has a diameter of about ⅛ inch. Of course, the diameter and the length of the respective rods 16, 20 and respective pins 18, 22 presented by the bullet starter 10 are determined by the dimensions of the hollow-point bullets to be used and, with respect to the driver rod 20, the length of the barrel into which the bullet is to be driven.

While the impact member 14 here shown includes a relatively short starter rod 16, it is to be understood that a starter pin 18 can extend directly from the handle 12 without the rod 16 there between. The proximal ends of both the starter rod 16 and the driver rod 20 are glued or held by friction or pressure fit within respective recesses bored as known in the art into the handle 12. If the starter pin 18 extends directly from the handle 12 with no starter rod 16 there between, the proximal end of the starter pin 18 would then be likewise glued or otherwise retained within an appropriately-shaped recess as would be recognized by the skilled artisan. Although the construction here shown in the preferred embodiment includes a wooden handle 12 and brass rods 16, 20 and pins 18, 22, it is to be understood that any materials can be chosen so long as the materials accomplish the utility of the present invention. Thus, molded-plastic construction, either one-piece or of separate parts, represents one such alternative, non-limiting example of product production.

Figure 3:
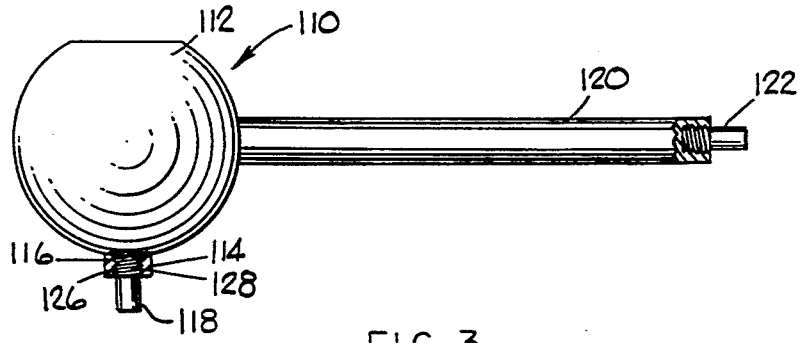
FIG. 3 is perspective view of a second embodiment of a bullet starter, with a portion thereof broken away.

Referring to FIG. 3, a second embodiment of a bullet starter 110 for loading a conical hollow-point bullet into a barrel of a muzzle loading firearm is shown. The starter 110 has a substantially spherical wooden handle 112 and an impact member 114, with the impact member 114 comprising a relatively short starter rod 116 extending from the handle 112 and having disposed at its distal end a starter pin 118 which is releasably removable from the starter rod 116. Specifically, and as shown in the broken-away portion of the starter rod 116 in FIG. 3, the distal end of the starter rod 116 is tapped and provided with a screw bore 126, while the proximal end of the starter pin 118 is constructed with screw threads 128. In this manner, different sizes of starter pins 118 can be interchanged with each other without changing complete tools.

At substantially 90° from the starter rod 116, a relatively long driver rod 120 extends from the handle 112. At the distal end of the driver rod 120 is disposed a driver pin 122 which is releasably removable from the driver rod 120 in the same manner as described above in relation to the starter pin 118. Thus, differently-sized driver pins 122 likewise can be interchanged with each other. Construction materials for the embodiment of FIG. 3 are the same as those employed for the embodiment of FIGS. 1 and 2. Also, in the same manner as described above, if the starter pin 118 extends directly from the handle 112, the handle 112 can be provided with a threaded recess that accommodates a thread disposed at the proximal end of the starter pin 118, thereby permitting interchangeability of starter pins 118 as earlier related.

It is also to be noted that a handle can be a typical muzzle-loading ramrod, as known in the art, which has at one end thereof a tapped, threaded opening for accepting various threaded devices such as cleaning tools to be used within the barrel of the gun. When such a ramrod is the handle, an interchangeable starter pin as described above can be releasably retained in the threaded opening to thus provide a non-distorting contact with the hollow point in the nose of a barrel-lodged hollow-point bullet as the bullet is thereby moved within the barrel.

Figure 4:
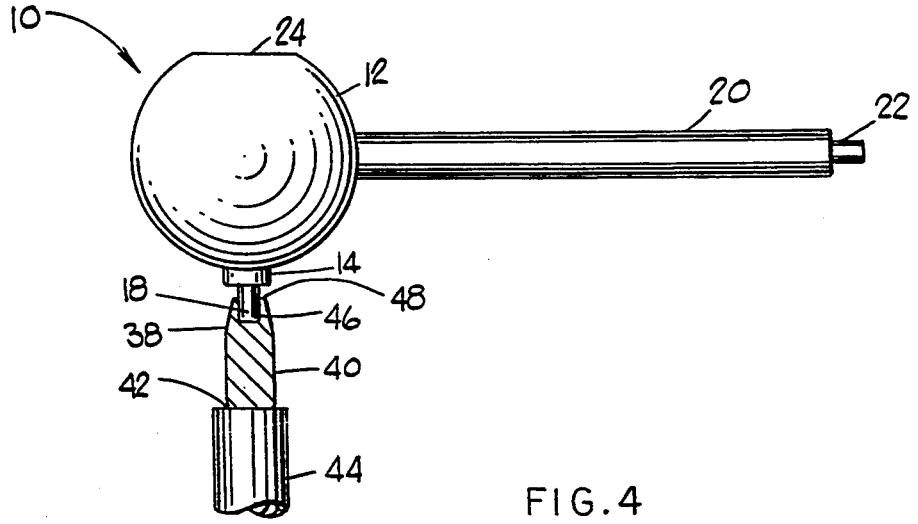
FIG. 4 is an elevation view of the bullet starter of FIG. 1 is use with a hollow-point bullet being loaded into a barrel of a muzzle loading firearm.

Use of the bullet starter 10 of FIGS. 1 and 2 is illustrated in FIG. 4. In particular, an operator uses the bullet starter 10 to load a hollow-point bullet 40 (shown in section) into the distal opening 42 of a barrel 44 (partially shown) of a muzzle loading firearm (not shown). The hollow-point bullet 40 is conical in shape and has a nose 38 having a recess therein, with this recess forming the hollow point 46. The hollow point 46 has a floor at the bottom thereof, a diameter, and a depth.

The first step in using the bullet starter 10 is to position the proximal end of the bullet 40 within the distal opening 42 of the barrel 44 such that the nose 38 is distal to and in alignment with the longitudinal axis of the barrel 44. Second, the starter pin 18 is inserted into the hollow point 46. The depth or length of the starter pin 18 is greater than the depth of the hollow point 46, while the diameter of the starter pin 18 is less than the diameter of the hollow point 46. Therefore, no part of the starter pin 18 is in contact with the border 48 of the hollow point at the distal end of the nose 38. Once the above-described insertion of the starter pin 18 into the hollow point is accomplished, the user strikes the flattened area 24 of the handle 12 with great impact as from a hand with a hammer-like blow and thereby forces the bullet 40 into the barrel 44. Because the only significant contact of the impact member 14 with the hollow-point bullet 40 is that of the starter pin 18 against the floor of the hollow point 46, the nose 38 of the bullet 40 is not distorted during impact and resultant force, and subsequent discharge performance of the bullet 40 is not compromised.

Once the bullet 40 is lodged within the end portion of the barrel 44 and its surface bears the rifling of the inside wall of the barrel 44, it is necessary to move the bullet 40 deeper within the barrel 44 for an ultimate firing position. To accomplish this task, the driver rod 20 and driver pin 22 are employed. Specifically, the driver pin 22, whose depth or length and diameter are dimensioned in like manner to the starter pin 18, is inserted into the hollow point 46 and significantly contacts only the floor of the hollow point 46. Thereafter, force is applied to the handle 12 to push the bullet 40 deeper into the barrel 44. The distance of travel into the barrel 44 is, of course, limited by the length of the driver rod 20. As is apparent, the bullet starter described above accomplishes placement of a hollow-point bullet within a barrel of a firearm without distorting the nose of the bullet.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

I claim:

1. A bullet starter for loading a conical hollow-point bullet into a barrel of a muzzle loading firearm, the starter comprising:

a) a handle; and b) an impact member comprising an outwardly protruding starter pin in communication with the handle, said starter pin insertable into a hollow point of a hollow-point bullet, said hollow point having a floor, a diameter, and a depth, with the starter pin having a diameter less than the diameter of the hollow point and having a depth greater than the depth of the hollow point.

2. A bullet starter as claimed in claim 1 wherein the starter pin is disposed distally from the handle.

3. A bullet starter as claimed in claim 2 wherein the starter pin is disposed at the end of a starter rod, said starter rod attached to the handle.

4. A bullet starter as claimed in claim 3 wherein the handle is substantially spherical.

5. A bullet starter as claimed in claim 4 wherein the handle has additionally protruding therefrom a driver rod for forcing the hollow-point bullet to a deeper site within a barrel after said bullet is lodged in the barrel, the driver rod having a driver pin disposed at the end thereof for insertion into the hollow point, said driver pin having a diameter less than the diameter of the hollow point and having a depth greater than the depth of the hollow point.

6. A bullet starter as claimed in claim 5 wherein the driver rod is disposed at substantially 90° from the starter pin.

7. A bullet starter as claimed in claim 1 wherein the handle is substantially spherical.

8. A bullet starter as claimed in claim 1 wherein the handle has additionally protruding therefrom a driver rod for forcing the hollow-point bullet to a deeper site within a barrel after said bullet is lodged in the barrel, the driver rod having a driver pin disposed at the end thereof for insertion into the hollow point, said driver pin having a diameter less than the diameter of the hollow point and having a depth greater than the depth of the hollow point.

9. A bullet starter as claimed in claim 8 wherein the driver rod is disposed at substantially 90° from the starter pin.

10. A bullet starter for loading a conical hollow-point bullet into a barrel of a muzzle loading firearm, the starter comprising:

a) a handle; and b) an impact member comprising an outwardly protruding starter pin in communication with the handle, said starter pin releasably retained and replaceable with another releasably retained starter pin and insertable into a hollow point of a hollow-point bullet, said hollow point having a floor, a diameter, and a depth, with the starter pin having a diameter less than the diameter of the hollow point and having a depth greater than the depth of the hollow point.

11. A bullet starter as claimed in claim 10 wherein the starter pin is disposed at the end of a starter rod, said starter rod attached to the handle.

12. A bullet starter as claimed in claim 10 wherein the handle has additionally protruding therefrom a driver rod for forcing the hollow-point bullet to a deeper site within a barrel after said bullet is lodged in the barrel, the driver rod having a driver pin disposed at the end thereof for insertion into the hollow point, said driver pin having a diameter less than the diameter of the hollow point and having a depth greater than the depth of the hollow point.

13. A bullet starter as claimed in claim 10 wherein the driver pin is releasably retained and replaceable with another releasably retained driver pin.

14. A bullet starter for loading a conical hollow-point bullet into a barrel of a muzzle loading firearm, the starter comprising:

a) a substantially spherical handle;

b) an impact member comprising an outwardly protruding starter pin in communication with the handle and disposed distally from the handle at the end of a starter rod attached to the handle, said starter pin insertable into a hollow point of a hollow-point bullet, said hollow point having a floor, a diameter, and a depth, with the starter pin having a diameter less than the diameter of the hollow point and having a depth greater than the depth of the hollow point, and further wherein the starter pin is releasably retained and replaceable with another releasably retained starter pin; and c) a driver rod protruding from the handle for forcing the hollow-point bullet to a deeper site within a barrel after said bullet is lodged in the barrel, the driver rod having a driver pin disposed at the end thereof for insertion into the hollow point, said driver pin having a diameter less than the diameter of the hollow point and having a depth greater than the depth of the hollow point.

* * * * *